US006131403A

United States Patent [19]

Ji

[11] Patent Number: 6,131,403

[45] Date of Patent: Oct. 17, 2000

[54] REFRIGERATOR WITH A COOL AIR DISPERSING DEVICE CAPABLE OF PREVENTING BACKFLOW OF AIR IN A COOLING COMPARTMENT

[75] Inventor: Joon Dong Ji, Suwon, Rep. of Korea

[73] Assignee: Samsung Electronics Co., Ltd., Suwon, Rep. of Korea

[21] Appl. No.: 09/159,872

[22] Filed: Sep. 24, 1998

[30] Foreign Application Priority Data

| | | | |
|---|---|---|---|
| Sep. 24, 1997 | [KR] | Rep. of Korea | 97-48577 |
| Sep. 24, 1997 | [KR] | Rep. of Korea | 97-48578 |
| Sep. 24, 1997 | [KR] | Rep. of Korea | 97-48579 |

[51] Int. Cl.[7] ..... F25D 17/04

[52] U.S. Cl. ..... 62/186; 62/408; 454/153

[58] Field of Search ..... 62/186, 408, 407, 62/440, 452, 404; 454/285, 153, 155, 313

[56] References Cited

U.S. PATENT DOCUMENTS

| | | | |
|---|---|---|---|
| 4,407,186 | 10/1983 | Izumi et al. | 98/2 |
| 4,462,304 | 7/1984 | Hashimoto | 98/40 V |
| 4,738,116 | 4/1988 | Himeno et al. | 62/186 |
| 4,767,096 | 8/1988 | Bouvot | 251/25 |
| 5,176,568 | 1/1993 | Nagatomo et al. | 454/285 |
| 5,442,913 | 8/1995 | Cho et al. | 60/518 |
| 5,660,586 | 8/1997 | Chiu et al. | 454/200 |
| 5,688,167 | 11/1997 | Kim | 454/153 |
| 5,737,935 | 4/1998 | Heo | 62/186 |
| 5,738,580 | 4/1998 | Baek | 454/285 |
| 5,918,479 | 7/1999 | Ji et al. | 62/408 |
| 5,921,861 | 7/1999 | Yoon | 454/285 |
| 5,947,813 | 9/1999 | Chow et al. | 454/155 |

*Primary Examiner*—Henry Bennett
*Assistant Examiner*—Marc Norman
*Attorney, Agent, or Firm*—Burns, Doane, Swecker & Mathis, L.L.P.

[57] ABSTRACT

Disclosed is a refrigerator having a cool air dispersing device. A duct housing forming a cool air duct is installed on a rear part of a cooling compartment, and many cool air discharge ports open into the cooling compartment are formed on the duct housing. In the cool air duct are installed many cool air dispersing blades of planar plate shape corresponding to the discharge ports respectively and capable of rotating. The blades control a discharge direction of cool air supplied into the cooling compartment according to a rotational position thereof. The blades have a size similar to the discharge ports, and can close the discharge ports at a predetermined rotational position thereof. While a cooling system is not operating, the discharge ports are closed by the blades, whereby the backflow of air in the cooling compartment toward an evaporator is prevented, and less frost is generated on the evaporator.

9 Claims, 19 Drawing Sheets

REFRIGERATOR WITH A COOL AIR DISPERSING DEVICE CAPABLE OF PREVENTING BACKFLOW OF AIR IN A COOLING COMPARTMENT

BACKGROUND OF THE INVENTION

1. Field of the Invention

The present invention relates to a refrigerator, and more particularly, to a refrigerator having a cool air dispersing device capable of dispersing cool air supplied into a cooling compartment horizontally and vertically, and preventing backflow of air in the cooling compartment toward an evaporator.

2. Prior Art

In general, a refrigerator has a cabinet for forming a pair of cooling compartments, i.e., a freezing compartment and a fresh food compartment which are partitioned by a partitioning wall, a freezing compartment door and a fresh food compartment door for opening/closing the cooling compartments respectively, and a cooling system for supplying the freezing compartment and the fresh food compartment with cool air which is comprised of a compressor, a condenser and an evaporator. The cool air generated by the evaporator flows along a cool air duct formed in a rear wall of each compartment, and then is supplied into each cooling compartment by a blowing fan through cool air discharge ports opened thereinto.

In such a conventional refrigerator, however, there exist an area on which the cool air discharged through the cool air discharge ports is concentrated, and an area to which a relatively small amount of cool air is supplied, so there occurs a deviation of temperature in the cooling compartments and uniform cooling cannot be achieved. Therefore, the refrigerator adopting so called tri-dimensional cooling method which has amended such a problem has been proposed. In the refrigerator adopting the tri-dimensional cooling method, the cool air discharge ports are provided at both side walls as well as at the rear wall of the cooling compartment in order to promote the uniform cooling.

However, in such a refrigerator adopting the tri-dimensional cooling method, since the cool air is discharged through the cool air discharge ports in fixed directions, there may be a dead-zone at an edge area which is not supplied with the cool air sufficiently. In particular, since the cool air duct has to be provided not only in the rear wall but also in the side walls, there are problems that the space for storing food is reduced and the manufacturing cost increases due to the increased number of components and processes.

The uniform distribution of cool air has risen to an important problem in relation to the trend to use large-sized refrigerators.

In consideration of such a problem, the applicant of this invention has proposed a refrigerator having a device for dispersing cool air in International Patent Application WO 95/27278. FIGS. 1 through 3 are a side view, a partial enlarged sectional view, and an exploded perspective view of main elements of the refrigerator having the device for dispersing cool air.

The conventional refrigerator having the device for dispersing cool air has a pair of cooling compartments 2 and 3 in a cabinet 1 with hexahedral shape, which are partitioned from each other by a partitioning wall 5. The cooling compartments 2 and 3 are called a freezing compartment 2 of relatively low temperature and a fresh food compartment 3 of relatively high temperature. On the front opening of the cooling compartments 2 and 3, doors 6 and 7 for opening/closing them are installed respectively. In the cabinet 1 is installed a cooling system comprising a compressor 11, a condenser (not shown), a freezing compartment evaporator 12*a*, and a fresh food compartment evaporator 12*b*. The cool air generated from the evaporators 12*a* and 12*b* is supplied to the corresponding compartments 2 and 3 by a freezing compartment fan 13*a* and a fresh food compartment fan 13*b* respectively.

A duct plate 9 of partial cylinder shape having cool air discharge ports 16 opened to the fresh food compartment 3 is attached to an inner wall plate 23 forming a rear inner wall surface of the fresh food compartment 3, and a cool air duct 15 and a circulation duct 17 separated from each other by a seal plate 25 are provided between the duct plate 9 and a rear wall 4 of the cabinet 1. In the cool air duct 15 is installed a duct member 21 for guiding the cool air blown by the fresh food compartment fan 13*b* downwardly. The cool air generated by the fresh food compartment evaporator 12*b* is blown by the fresh food compartment fan 13*b*, and then supplied to the fresh food compartment 3 via the cool air duct 15 and the cool air discharge ports 16.

A cool air dispersing device 130 is installed in the cool air duct 15. The cool air dispersing device 130 is comprised of a rotational shaft 131 having a vertical axis, cool air dispersing blades 132 assembled with the rotational shaft 131 at areas adjacent to the cool air discharge ports 16 respectively, and a driving motor 135 for rotating the rotational shaft 131. Each of the cool air dispersing blades 132 is comprised of three discs 136, 137 and 138 disposed in parallel with each other along the axis direction, and a first blade part 133 and a second blade part 134 disposed between the discs 136, 137 and 138. Each of the blade parts 133 and 134 are bent so that their cross section is a lax shape of alphabet S. The blade parts 133 and 134 are bent to the opposite directions to each other.

In the refrigerator having the above-described constitution, when the driving motor 135 rotates the rotational shaft 131 at a low speed, the cool air flowing along the cool air duct 15 changes its flowing direction along the bent surface of the cool air dispersing blades 132, and is discharged into the fresh food compartment 3 to be dispersed horizontally. Meanwhile, when the concentrative cooling on a specific area is needed, the driving motor 135 stops the rotational shaft 131 in accordance with the direction of the cool air dispersing blades 132 so that the cool air is concentrated on the specific area.

However, since the blade parts 133 and 134 of the cool air dispersing device 130 are bent to be shaped into the lax alphabet S, the smooth flow of cool air may be impeded by a vortex of the cool air formed about the cool air discharge ports 16.

Moreover, although such a conventional cool air dispersing device 130 can achieve the uniform distribution of the cool air horizontally, the vertical distribution of the cool air has not been be uniform sufficiently, so there is a limitation in realizing the uniform cooling through the overall area of the fresh food compartment 3.

Moreover, in such a conventional refrigerator, since the cool air discharge ports 16 are open always, relatively warm air in the fresh food compartment 3 may flows back toward the evaporator 12*b*, which may cause the generation of frost on the evaporator 12*b*. When the frost is generated on the evaporator 12*b*, the heat exchange efficiency of the evaporator 12*b* is lowered, and therefore, the cooling efficiency of the overall cooling system is lowered.

Furthermore, in order to remove the frost, the evaporator has to be heated using an additional defrosting heater (not shown), so the cooling efficiency is more lowered, and consumption of electrical power increases.

SUMMARY OF THE INVENTION

The present invention has been proposed to overcome the above-described problems in the prior art, and accordingly it is the object of the present invention to provide a refrigerator capable of preventing vortex of cool air, achieving effectively the uniform distribution of cool air both vertically, and preventing backflow of air in a cooling compartment toward an evaporator.

Another object of the present invention is to provide a refrigerator capable of achieving effectively the uniform distribution of cool air horizontally and vertically, and thereby maintaining the distribution of temperature in the cooling compartment more uniform.

To achieve the above object, the present invention provides a refrigerator comprising: a duct housing forming a cool air duct for guiding cool air generated by an evaporator, said duct housing having a plurality of cool air discharge ports open into a cooling compartment; a plurality of cool air dispersing blades of planar plate shape corresponding to the discharge ports respectively, said cool air dispersing blades being capable of rotating, said cool air dispersing blades for controlling a discharge direction of cool air supplied into said cooling compartment according to a rotational position thereof and for closing the discharge ports at a predetermined rotational position thereof; and a means for rotating said cool air dispersing blades.

Here, said rotating means comprises: a link member having a plurality of hinge assembly parts assembled with said cool air dispersing blades at positions distanced from rotational axes thereof; a driving motor for driving said link member; and a driving cam for converting a rotational movement of said driving motor to a reciprocal movement of said link member. Said driving cam comprises a cam body assembled coaxially with a driving shaft of said driving motor and formed with a cam groove on an outer surface thereof; and said link member has an operation protrusion engaged with the cam groove.

Preferably, the discharge ports and said cool air dispersing blades are disposed so as to form a pair of lines.

To achieve another object of the present invention, the present invention provides a refrigerator further comprising a means for guiding the cool air in said cool air duct toward the respective lines of the discharge ports, selectively. Here, said guiding means comprises: a guide blade installed rotatably between the lines of the discharge ports, said guide blade for selectively guiding the cool air toward the respective lines of the discharge ports according to a rotational position thereof; and a means for driving said guide blade.

According to a preferred embodiment of the present invention, said driving means comprises a pivoting protrusion formed on said guide blade at a position distanced from a rotational axis thereof, said pivoting protrusion being engaged with a pivoting groove which is formed on said driving cam and has a shape of an ellipse substantially.

Furthermore, according to another preferred embodiment of the present invention, said driving means comprises a solenoid device having a core part fixed on a predetermined position, and a driving rod reciprocated by said core part and assembled with said guide blade at a position distanced from a rotational axis thereof.

It is preferable that said cool air dispersing blades are vertical dispersing blades capable of rotating about horizontal axes respectively, said vertical dispersing blades for controlling a vertical discharge direction of the cool air supplied into said cooling compartment according to a rotational position thereof.

According to the present invention, the vortex of the cool air about the cool air discharge ports does not occur. Further, the backflow of air in a cooling compartment toward an evaporator is prevented, whereby less frost is generated on the evaporator and cooling efficiency is improved. In particular, the horizontal discharge direction of cool air can be controlled by the guide blade, so the cool air can be uniformly dispersed vertically and horizontally, and a concentrative cooling on a specific area can be performed effectively.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
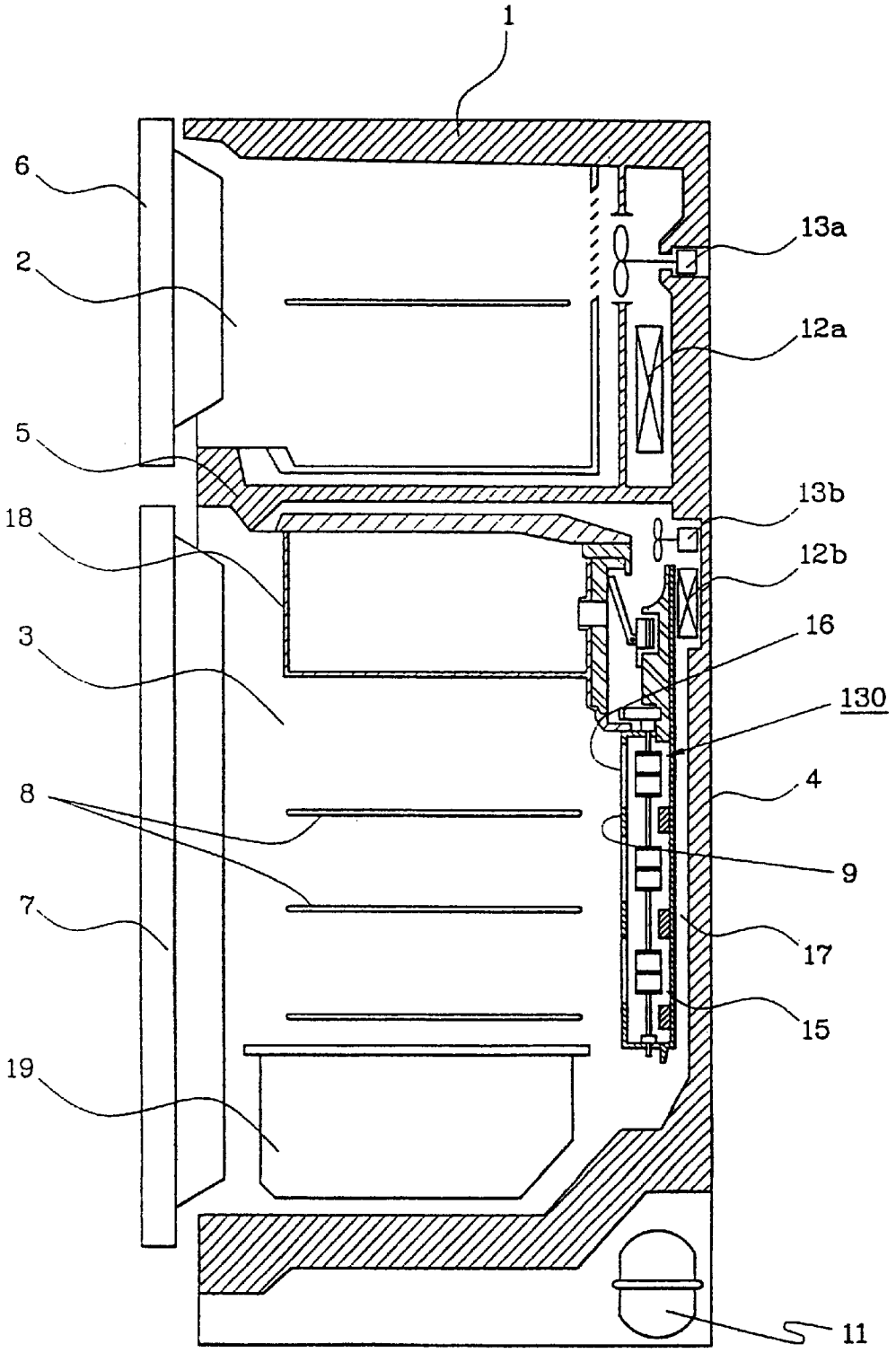
FIG. 1 (PRIOR ART)
FIG. 1 is a side sectional view of a conventional refrigerator having cool air dispersing blades.
Figure 2:
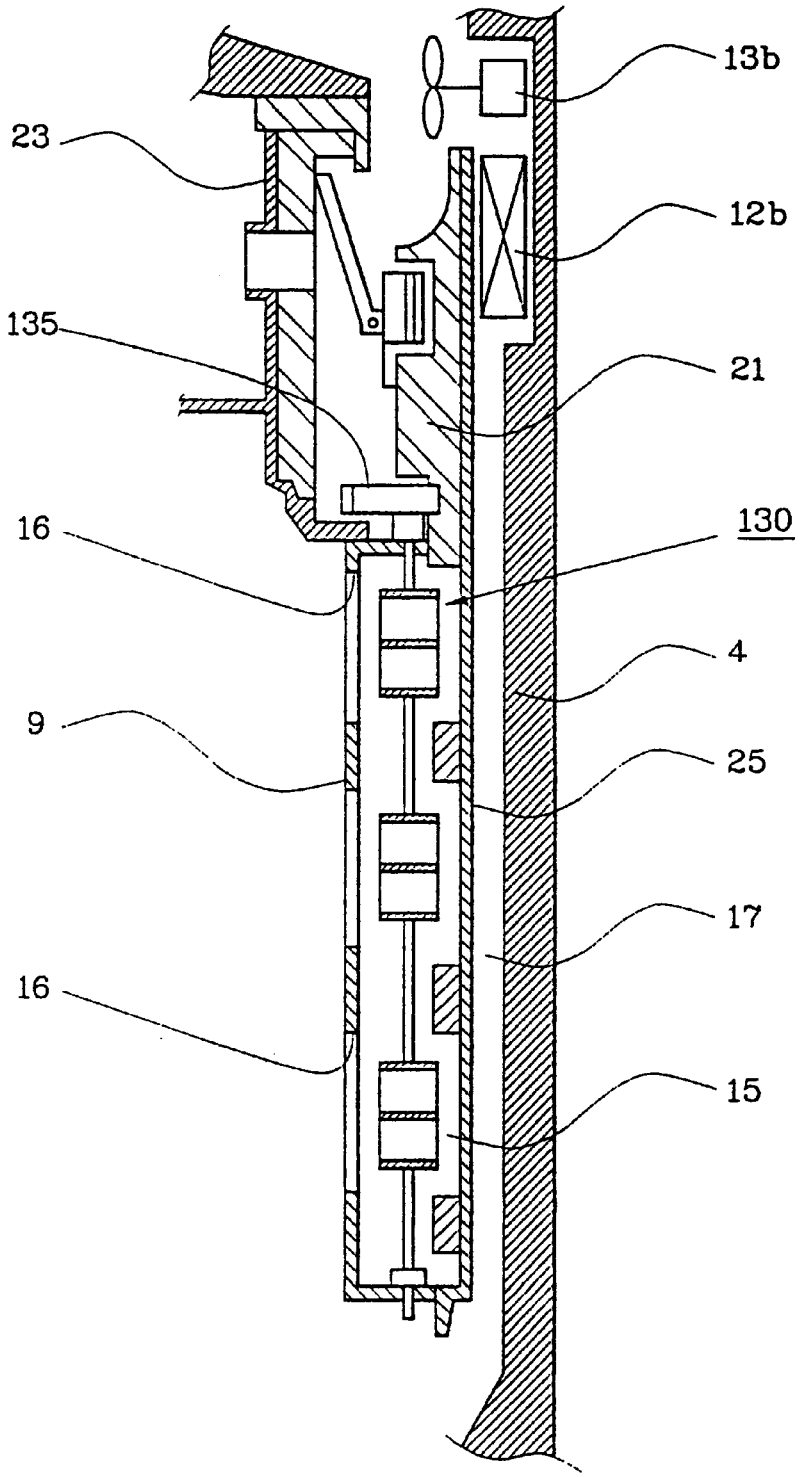
FIG. 2 (PRIOR ART)
FIG. 2 is a partial enlarged sectional view of FIG. 1.
Figure 3:
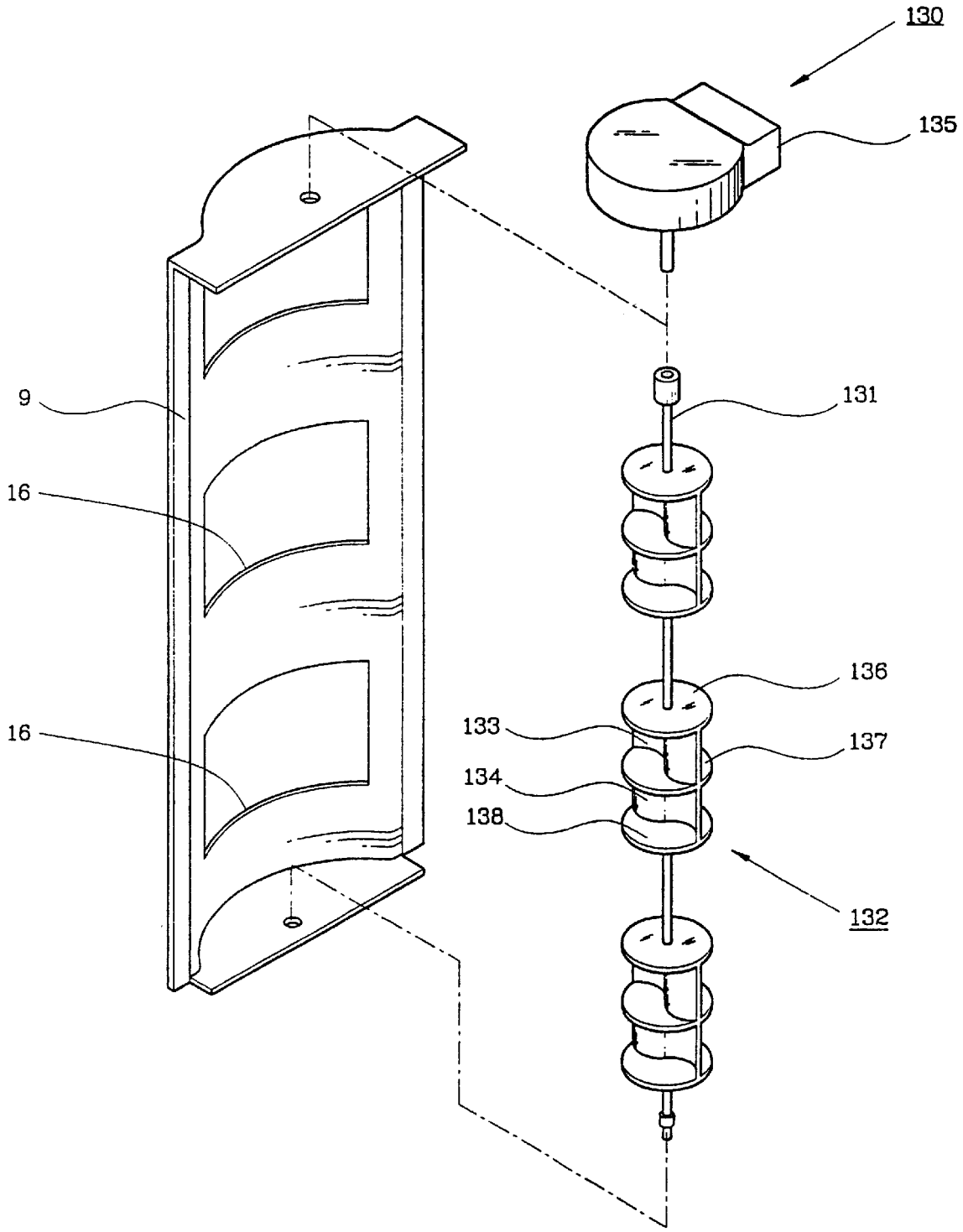
FIG. 3 (PRIOR ART)
FIG. 3 is an enlarged exploded perspective view of main elements of FIG. 2.

Hereinafter, the present invention will be described in detail with reference to the accompanying drawings. Parts identical to those in the conventional refrigerator shown in FIGS. 1 through 3 will be referred to with the same reference numerals.

Figure 4:
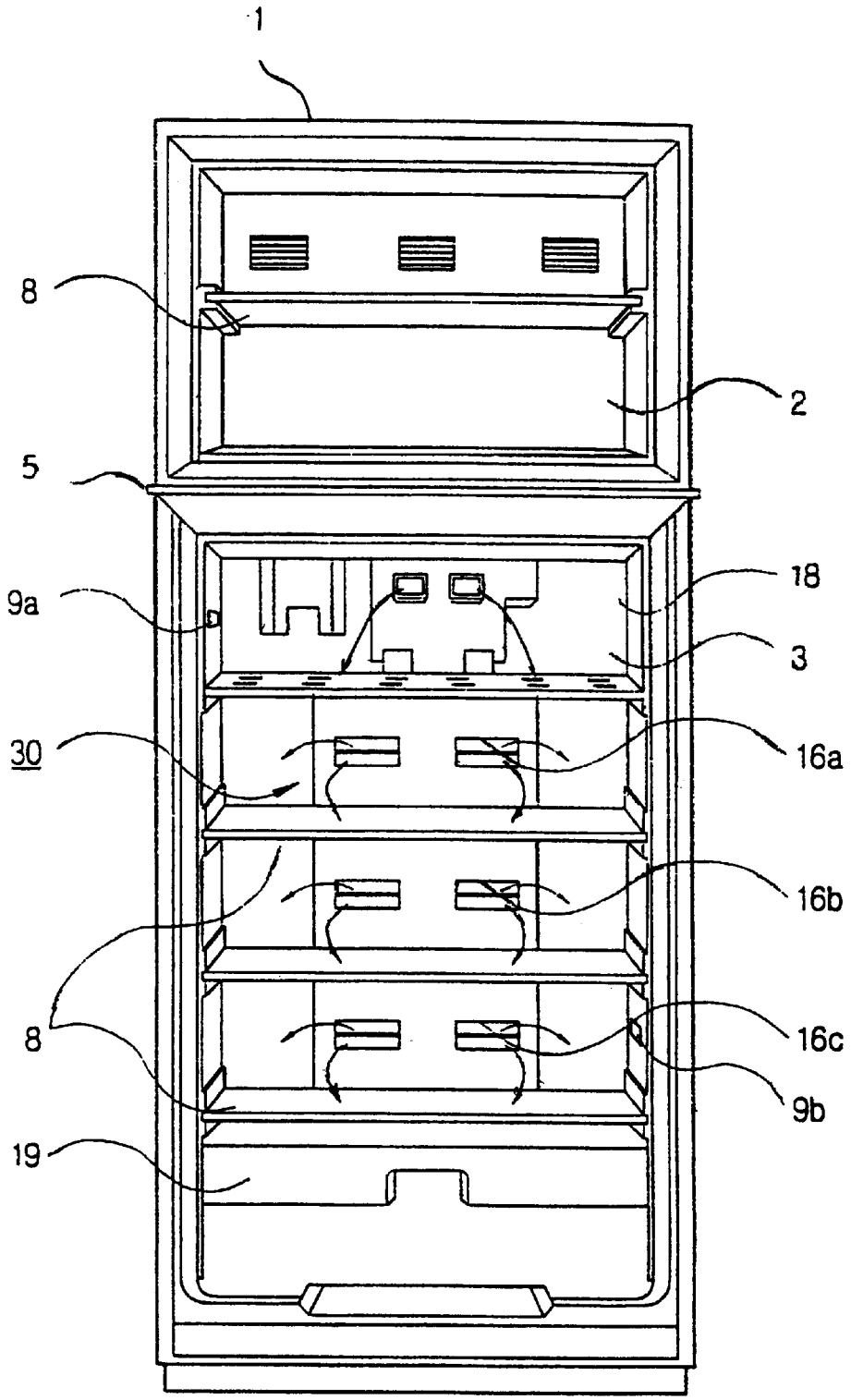
FIG. 4 is a front view of a refrigerator according to the first embodiment of the present invention.
Figure 5:
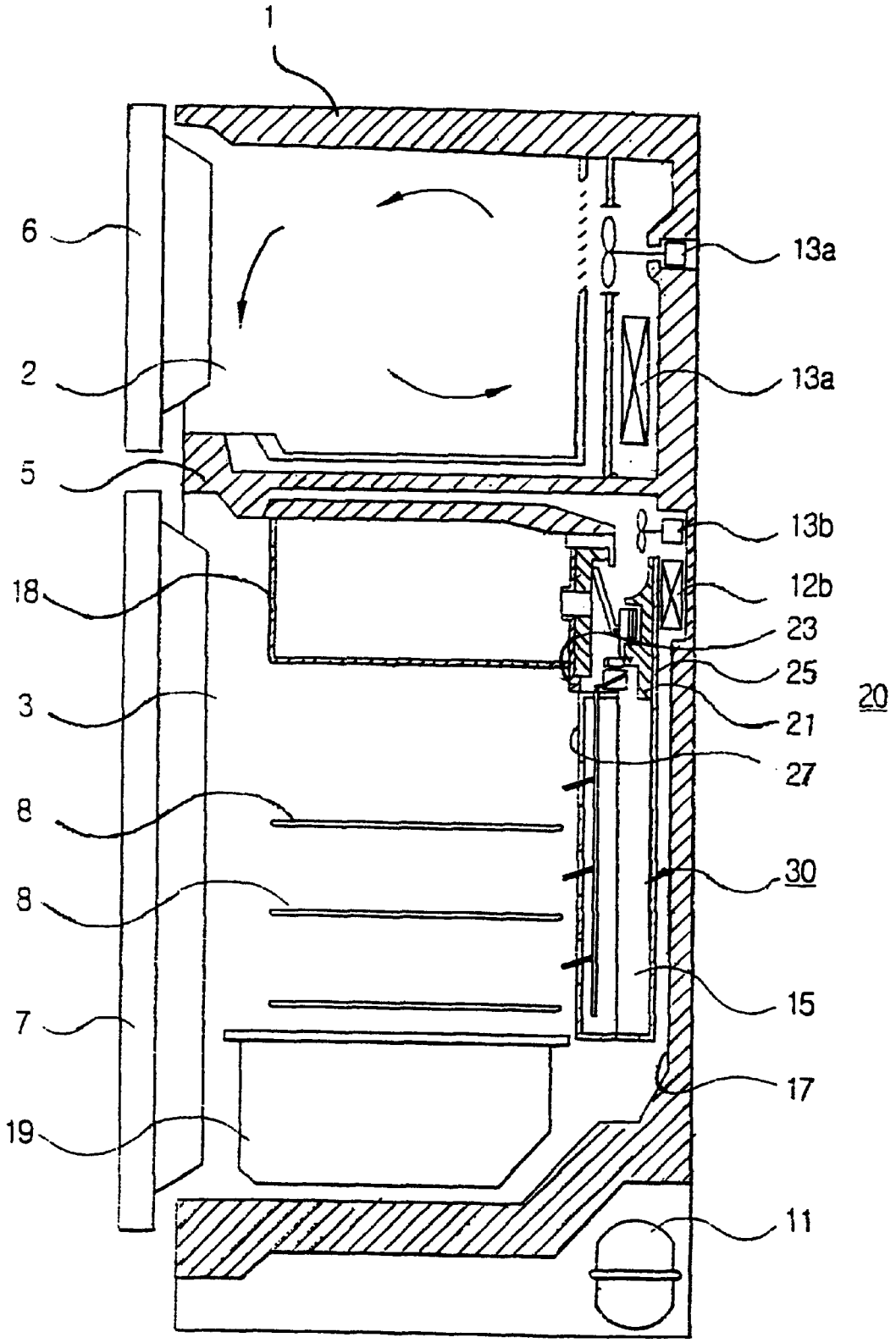
FIG. 5 is a side sectional view of FIG. 4.

FIG. 4 is a front view of a refrigerator according to the first embodiment of the present invention, and FIG. 5 is a side sectional view of FIG. 4. As shown in the figures, the refrigerator according to the present invention has, as the conventional refrigerator which has been illustrated with reference to FIGS. 1 through 3, a cabinet 1 forming freezing compartment 2 and a fresh food compartment which are partitioned by a partitioning wall 5. On the front openings of the freezing compartment 2 and the fresh food compartment 3, doors 6 and 7 for opening/closing them are installed respectively. In the fresh food compartment 3, shelves 8 for placing food thereon are installed, which divide the fresh food compartment 3 into three stratified area, i.e., an upper area, a middle area, and a lower area. A special fresh chamber 18 for storing food which are proper to a specific temperature range is formed at the upper part of the fresh food compartment 3, and a vegetable chamber 19 for storing vegetables is formed at the lower part of the fresh food compartment 3.

A pair of temperature sensors 9*a* and 9*b* are installed in the fresh food compartment 3. The temperature sensors 9*a* and 9*b* are respectively installed on the upper left area and the lower right area of in the fresh food compartment 3.

In the cabinet 1 is installed a cooling system comprising a compressor 11, a condenser (not shown), a freezing compartment evaporator 12*a*, and a fresh food compartment evaporator 12*b*. The cool air generated by the evaporators 12*a* and 12*b* is supplied into the corresponding cooling compartments 2 and 3 by the freezing compartment fan 13*a* and the fresh food compartment fan 13*b*.

A duct housing 20 for forming a cool air duct 15 providing a passage of cool air supplied from the evaporator 12*b* is installed on the rear area of the fresh food compartment 3. The duct housing 20 comprises a duct member 21 for forming the cool air duct 15, a front plate 23 attached to the front side of the duct member 21, a seal plate 25 attached to the rear side of the duct member 21, and a duct cover 27 installed at the lower side of the front plate 23.

A plurality of cool air discharge ports 16 open toward the fresh food compartment 3 are provided on the duct cover 27 along the longitudinal direction thereof by a predetermined interval therebetween. The duct cover 27 and the duct member 21 form the cool air duct 15 therebetween for guiding the movement of the cool air, and the cool air dispersing device 30 is installed in the cool air duct 15. The cool air dispersing device 30 which will be described later in detail supplies the cool air blown by the fresh food compartment fan 13*b* into the fresh food compartment 3. A circulation duct 17 connecting the fresh food compartment 3 and the fresh food compartment evaporator 12*b* is formed separately from the cool air duct 15. The air in the fresh food compartment 3 is circulated to the fresh food compartment evaporator 12*b* through the circulation duct 17.

Figure 6:
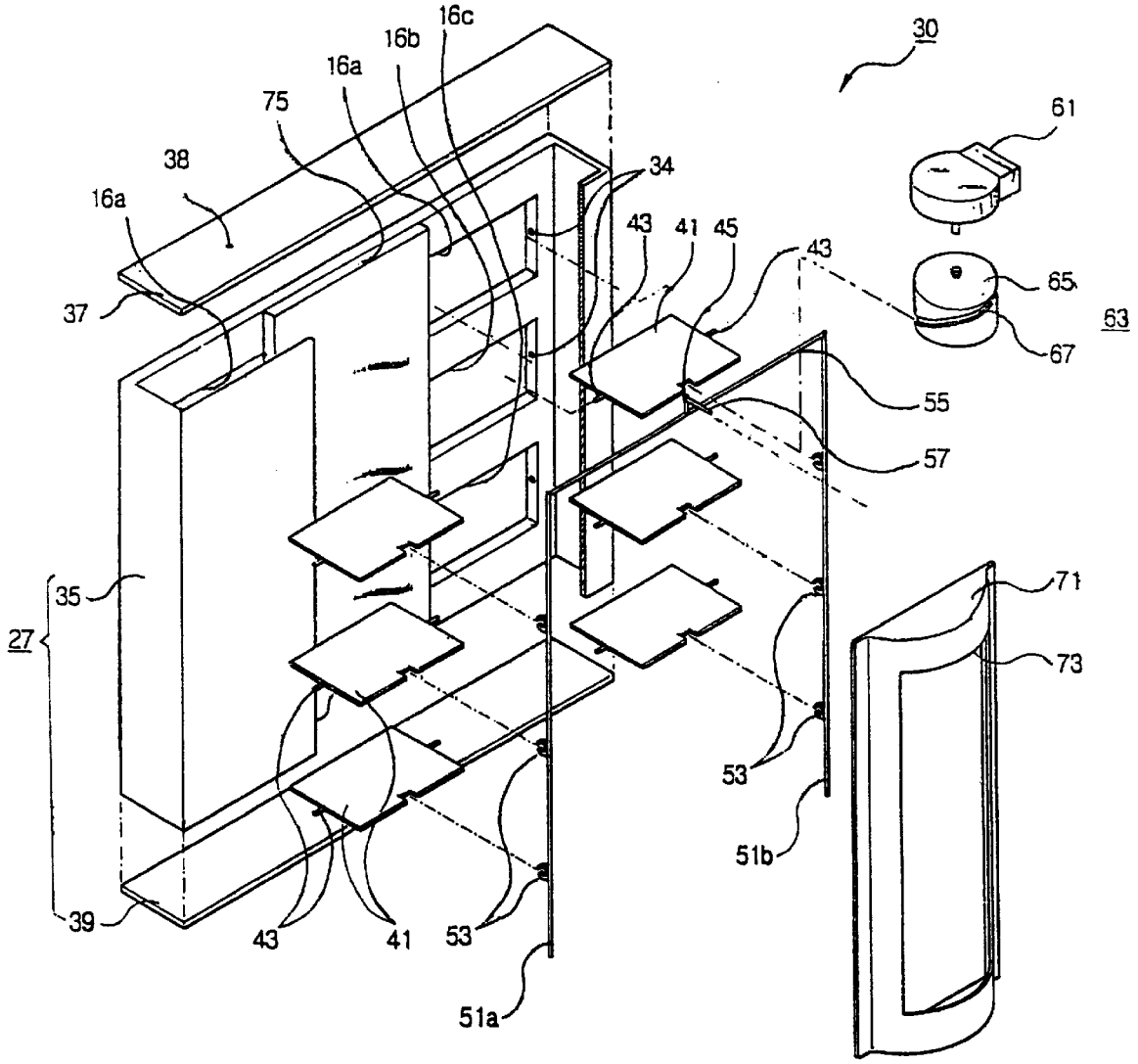
FIG. 6 is an enlarged exploded perspective view of a cool air dispersing device shown in FIGS. 4 and 5.
Figure 7:
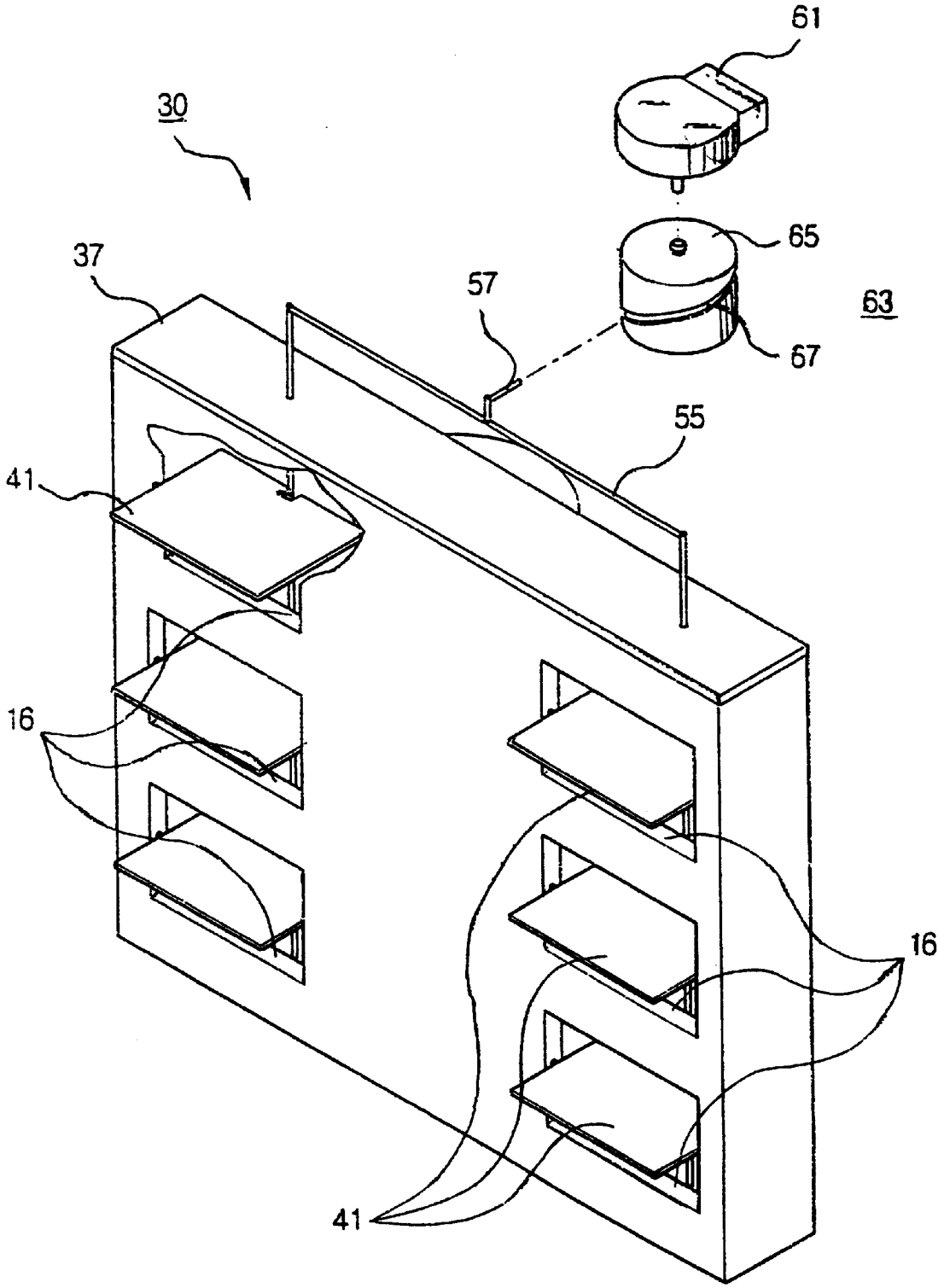
FIG. 7 is a perspective view of the assembled state of FIG. 6.

FIG. 6 is an enlarged exploded perspective view of the cool air dispersing device 30 according to the first embodiment of the present invention, and FIG. 7 is a perspective view of the assembled state of FIG. 6. As shown in the figures, a plurality of cool air discharge ports 16*a*, 16*b* and 16*c* forming a pair of lines vertically are formed on the duct cover 27 comprised of a body 35 and upper and lower plates 37 and 39 so as to be shaped into a rectangular cylinder. The discharge ports 16*a*, 16*b* and 16*c* correspond to the partitioned storage areas in the fresh food compartment 3, and in this embodiment, three discharge ports 16*a*, 16*b* and 16*c* are provided on each of the lines.

A rear plate 71 having a cool air supply hole 73 is attached to the rear side of the duct cover 27. The rear plate 71 is bent to be shaped into an arc so that it protrudes rearward. The cool air flowing into the cool air duct 15 is supplied into the inner space formed by the duct cover 27 through the cool air supply hole 73 of the rear plate 71, and then is discharged toward the fresh food compartment 3 through the discharge ports 16*a*, 16*b* and 16*c*.

On each of the cool air discharge ports 16*a*, 16*b* and 16*c* is installed a vertical dispersing blade 41. The vertical dispersing blades 41 are formed into a rectangular plate substantially so as to correspond to the rectangular shape of the respective discharge ports 16*a*, 16*b* and 16*c*. Furthermore, the vertical dispersing blades 41 have the same size as the discharge ports 16*a*, 16*b* and 16*c*, substantially.

The vertical dispersing blade 41 is formed with horizontal shafts 43 protruding sideward at the central parts of both side edges thereof. At both side edges of the respective discharge ports 16*a*, 16*b* and 16*c*, shaft holes 34 corresponding to the horizontal shafts 43 are formed. The horizontal shafts 43 are inserted into the shaft holes 34, and thereby the vertical dispersing blades are capable of rotating around the horizontal shafts 43. The vertical dispersing blade 41 is also formed with a hinge pin 45 at the central part of the rear edge thereof, which is assembled with a link members 51*a* and 51*b* described later.

Meanwhile, a pair of link members 51*a* and 51*b* are disposed in parallel with each other in the rear of the vertical dispersing blades 41, which are capable of being elevated/de-elevated vertically. The link members 51*a* and 51*b* have the shape of a long rod, and are disposed vertically. The link members 51*a* and 51*b* have hinge assembly parts 53 having the shape of a partial ring respectively assembled with the hinge pins 45 of the vertical dispersing blades 41. As the hinge pins 45 and the hinge assembly parts 53 are assembled with each other, the vertical dispersing blades 41 rotate within a predetermined angular range while the link members 51*a* and 51*b* are elevating/de-elevating.

Both of the link members 51*a* and 51*b* which are parallel with each other are connected with each other by a connection member 55. The upper ends of the link members 51*a* and 51*b* are disclosed onto the upper part of the upper plate 37 of the duct cover 27 through holes 38 formed at both side areas of the upper plate 37, and the connection member 55 connects the upper ends of the disclosed link members 51*a* and 51*b* with each other. Furthermore, the connection member 55 has an operation protrusion 57 extended upward and then bent rearward, and the operation protrusion 57 is engaged with a driving cam 63 which will be described later.

Meanwhile, a motor bracket (not shown) is installed on the upper area of the cool air duct 15, and a driving motor 61 is accommodated in and fixed by the motor bracket. As the driving motor 61, a stepping motor capable of rotating bilaterally and controlling the stop angular position thereof is preferably used, and the driving cam 63 is assembled with the driving shaft of the driving motor 61. The driving cam 63 has a cylindrical cam body 65 assembled coaxially with the driving shaft of the driving motor 61, and at the outer surface of the cam body 65, a cam groove 67 is formed which is a closed loop having a cam profile elevating/de-elevating vertically. The operation protrusion 57 formed on the connection member 55 is engaged with the cam groove 67, whereby the link members 51*a* and 51*b* elevates/de-elevates along the cam groove 67 while the driving cam 63 is rotating.

To the rear side of the duct cover 27 is attached a guide member 75 for guiding the cool air flowing into the inner space of the duct cover 27 through the cool air supply hole 73 of the rear plate 71 toward the discharge ports 16*a*, 16*b* and 16*c*. The central part of the guide member 75 is recessed so as to be arc-shaped.

Hereinbelow, the operation of the refrigerator having the above-described construction will be described.

FIGS. 8 through 13 are views showing the state of cool air dispersed by the vertical dispersing blades. When a desired temperature is set by a user, a microprocessor (not shown) in the refrigerator drives the compressor 11, by which cool air is generated around the evaporators 12*a* and 12*b*. The cool air generated by the evaporators 12*a* and 12*b* is blown by the fans 13*a* and 13*b*.

The cool air blown by the fresh food compartment fan 13*b* is supplied into the cool air duct 15, and the supplied cool air flows into the inner space formed by the duct cover 27 through the cool air supply hole 73 of the rear plate 71.

Figure 8:
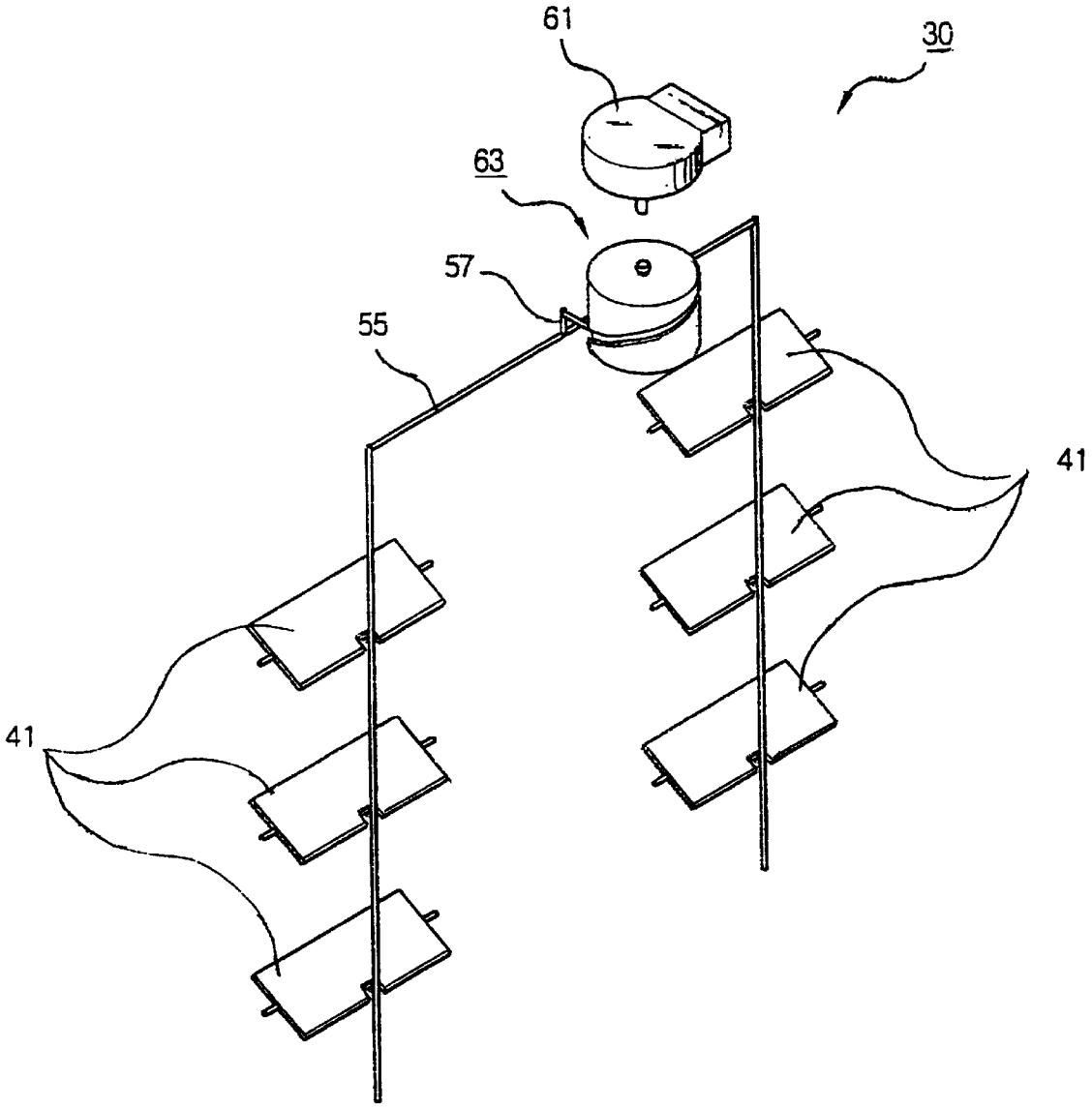
FIGS. 8 and 9 are views showing the cool air dispersing operation performed by the vertical dispersing blades shown in FIG. 6.
Figure 9:
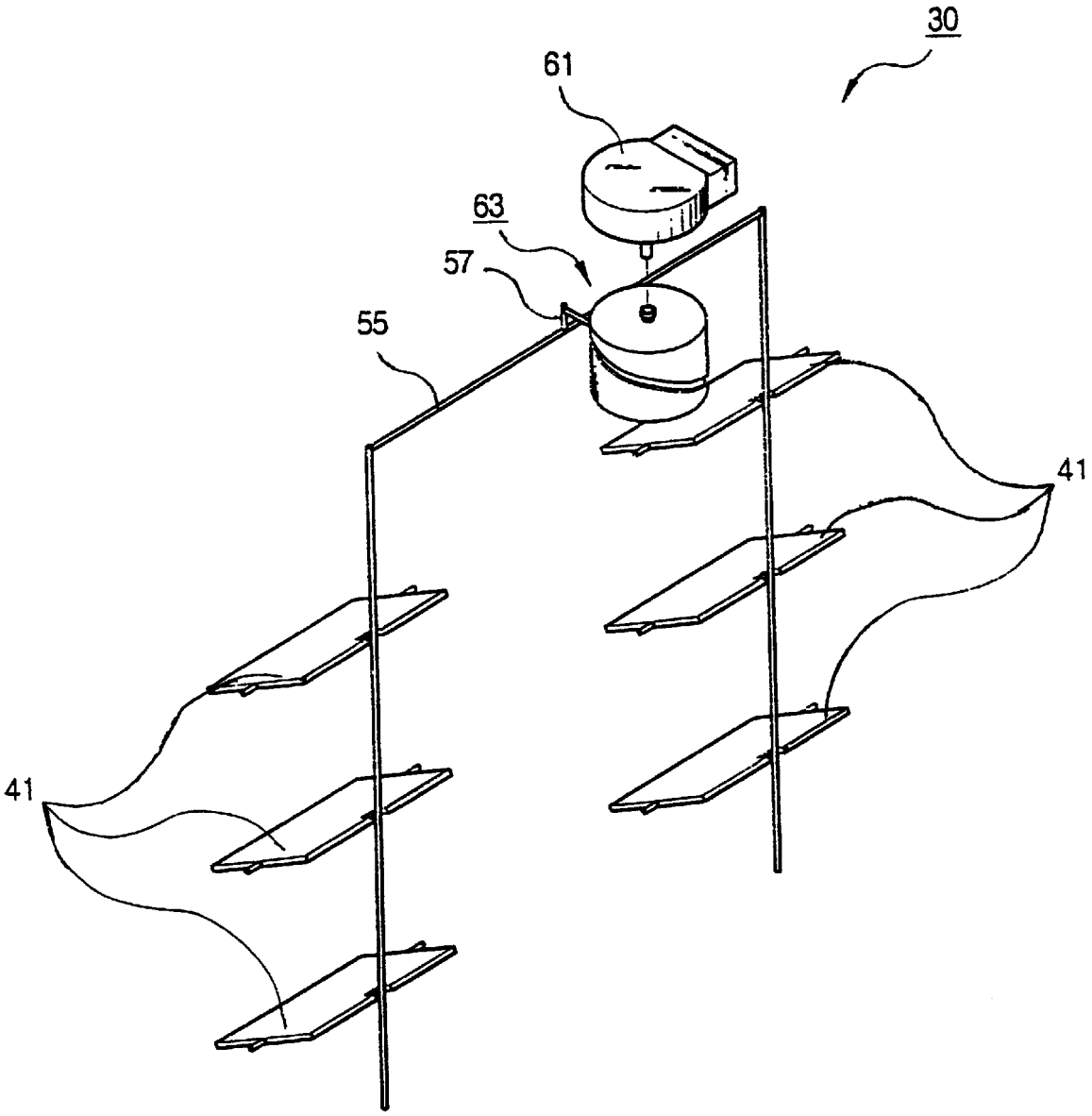
Figure 10:
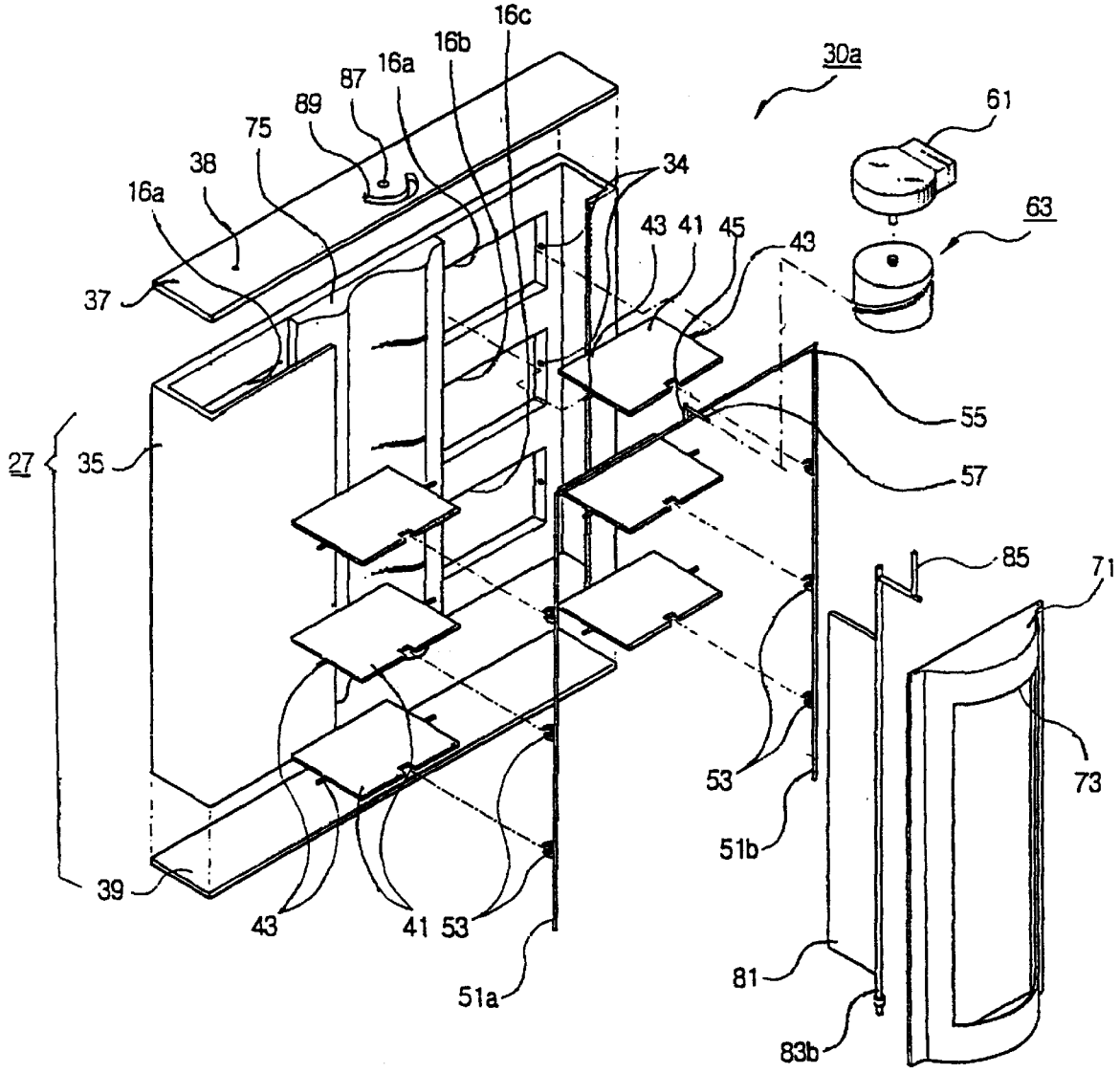
FIG. 10 is an enlarged exploded perspective view of a cool air dispersing device according to the second embodiment of the present invention.

As the driving cam 63 is rotated by the driving motor 61, the link members 51*a* and 51*b* are elevated/de-elevated, whereby the vertical dispersing blades 41 are reciprocally rotated within a predetermined angular range. While the driving motor 61 is operating, when the vertical dispersing blades are rotated upward as shown in FIG. 8, the cool air is discharged upward into the fresh food compartment 3, and when the vertical dispersing blades are rotated downward as shown in FIG. 9, the cool air is discharged downward into the fresh food compartment 3. As the vertical dispersing blades 41 are continuously reciprocated, the cool air is dispersed vertically, and thereby the cool air is supplied uniformly into the fresh food compartment 3.

Furthermore, since the vertical dispersing blades 41 are formed into a planar plate, vortex of cool air is not generated around the vertical dispersing blades 41, and the cool air is supplied into the fresh food compartment 3 more smoothly. Furthermore, since the discharge ports 16*a*, 16*b* and 16*c* are disposed throughout the overall area of the rear side of the fresh food compartment 3, the cool air can be supplied even into the corner areas in the fresh food compartment 3 smoothly.

The microprocessor in the refrigerator senses the temperatures in the fresh food compartment 3 using the temperature sensors 9*a* and 9*b*. The microprocessor calculates the deviation of temperatures in the fresh food compartment 3 on the basis of the signals from the temperature sensors 9*a* and 9*b*, and if the deviation is greater than a predetermined value, the microprocessor performs a concentrative cooling of an area of which temperature is high. That is, the microprocessor controls the vertical dispersing blades 41 using the driving motor 61 so that the area of which temperature is high is cooled in a concentrative manner. For example, if the temperature of the lower area in the fresh food compartment 3 is sensed to be highest, the microprocessor drives the driving motor 61 so that the vertical dispersing blades 41 are rotated downward as shown in FIG. 9, and stops the driving motor 61 in such a status. Then, the cool air is continuously discharged toward the lower area of the fresh food compartment 3, and the temperature in the fresh food compartment 3 becomes uniform in a short period of time.

Meanwhile, the backflow of air in the fresh food compartment 3 into the cool air duct 15 can be prevented by rotating the vertical dispersing blades 41 upward or downward maximally. Describing it in detail, if the fresh food compartment 3 is sufficiently cooled so that the temperature in the fresh food compartment 3 sensed by the temperature sensors 9*a* and 9*b* reaches the desired temperature, the microprocessor stops the operation of the compressor 11 and the fans 13*a* and 13*b*, whereby the supply of cool air into the fresh food compartment 3 is stopped. In such a situation, the microprocessor stops the vertical dispersing blades 41 when they are rotated upward or downward maximally so that the discharge ports 16*a*, 16*b* and 16*c* are closed by the vertical dispersing blades 41. Then, the backflow of the air in the fresh food compartment 3 toward the evaporator 12*b* through the cool air duct 15 is prevented, and the frost caused by the backflow air is not generated on the evaporator 12*b*. Preferably, flanges for airtightly closing the discharge ports 16*a*, 16*b* and 16*c* may be formed at the edges of the discharge ports 16*a*, 16*b* and 16*c*, so that the discharge ports 16*a*, 16*b* and 16*c* can be effectively closed.

FIGS. 10 through 14 show the cool air dispersing device according to the second embodiment of the present invention. In the description of the present embodiment, parts identical to those in the above-described first embodiment will not be illustrated and will be referred to with the same reference numerals.

In the cool air dispersing device 30*a* of the present embodiment, the constructions of the duct housing 20, the rear plate 71, the vertical dispersing blades 41, the link members 51*a* and 51*b*, and the driving motor 61 are the same as those of the above-described first embodiment. Meanwhile, the cool air dispersing device 30*a* further comprises a means for guiding the cool air so that the cool air is selectively discharged through the respective lines of the discharge ports 16*a*, 16*b* and 16*c*.

The guiding means comprises a horizontal guide blade 81 installed in the inner space formed by the duct cover 27. The horizontal guide blade 81 is accommodated in the cylindrical space formed by the rear plate 71 protruding rearward and the guide member 75 recessed frontward.

The horizontal guide member 81 is a rectangular plate, and is installed on a vertical shaft 83*b* disposed vertically. The upper end of the vertical shaft 83*b* is inserted into a supporting hole 87 formed on the upper plate 37 of the duct cover 27, and the lower end thereof is inserted into another supporting hole (not shown) formed on the lower plate 39 of the duct cover 27. Therefore, the horizontal guide blade 81 is rotatable around the vertical shaft 83*b*. The cool air flowing into the inner space of the duct cover 27 is guided left or right according to the rotational position of the horizontal guide blade 81.

Furthermore, on the upper part of the vertical shaft 83*b* is formed a pivoting protrusion 85 extended rearward from the vertical shaft 83*b* and then protruding upward. The upper plate 37 of the duct cover 27 is formed with an arc-shaped pivoting guide hole 89 formed around the supporting hole 87, and the pivoting protrusion 85 is disclosed onto the upper part of the upper plate 37 through the pivoting guide hole 89.

Figure 11:
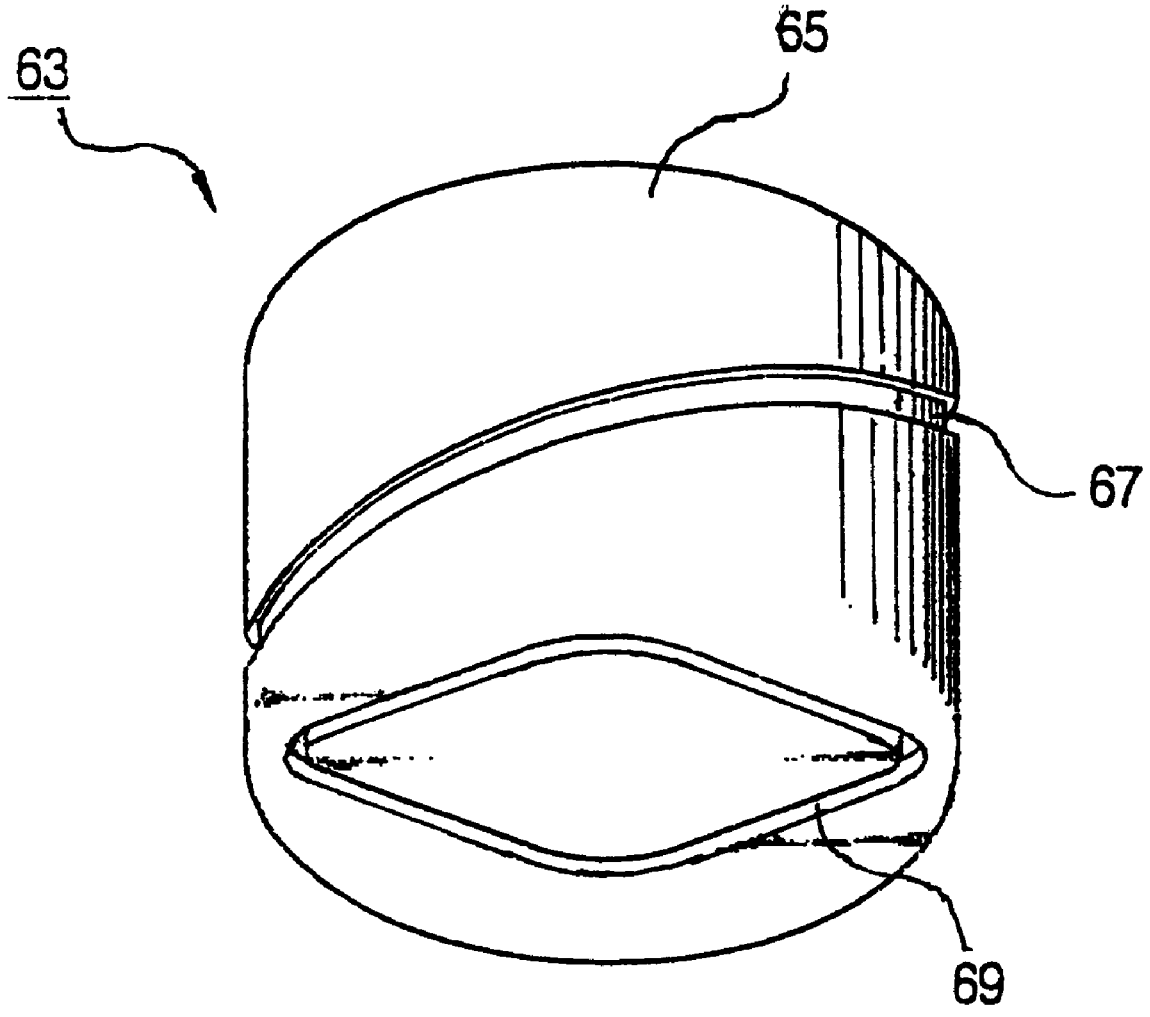
FIG. 11 is a perspective view showing the bottom side of the driving cam shown in FIG. 10.
Figure 12:
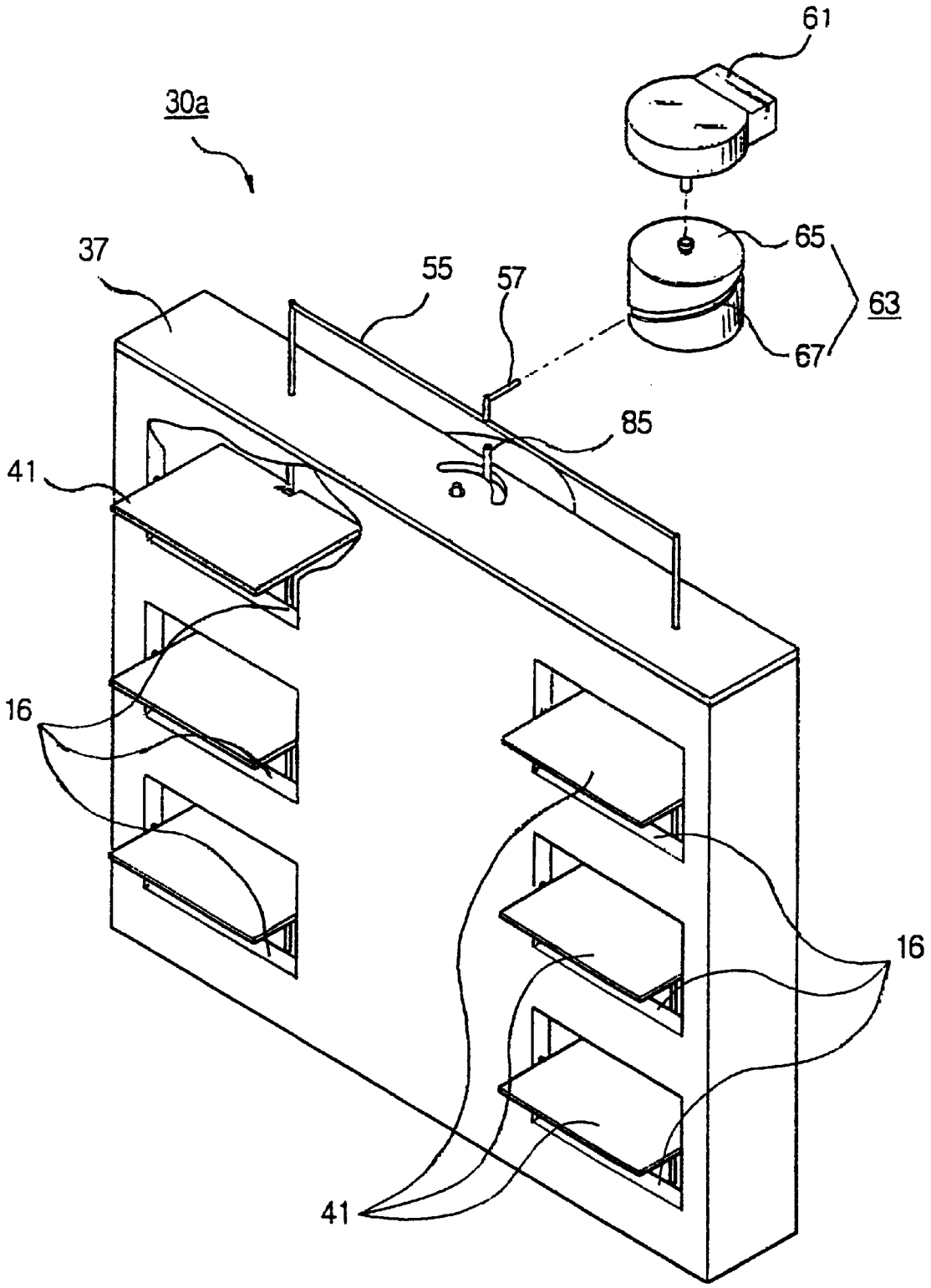
FIG. 12 is a perspective view of the assembled state of FIG. 10.

As shown in FIG. 11, a pivoting groove 69 is formed on the bottom surface of the driving cam 63. The pivoting groove 69 is a closed loop having a shape of an ellipse substantially, and the pivoting protrusion 85 is inserted into the pivoting groove 69. Accordingly, as the driving cam 63 is rotated, the pivoting protrusion 85 is rotated reciprocally within a predetermined annular range by the pivoting groove 69.

Figure 13:
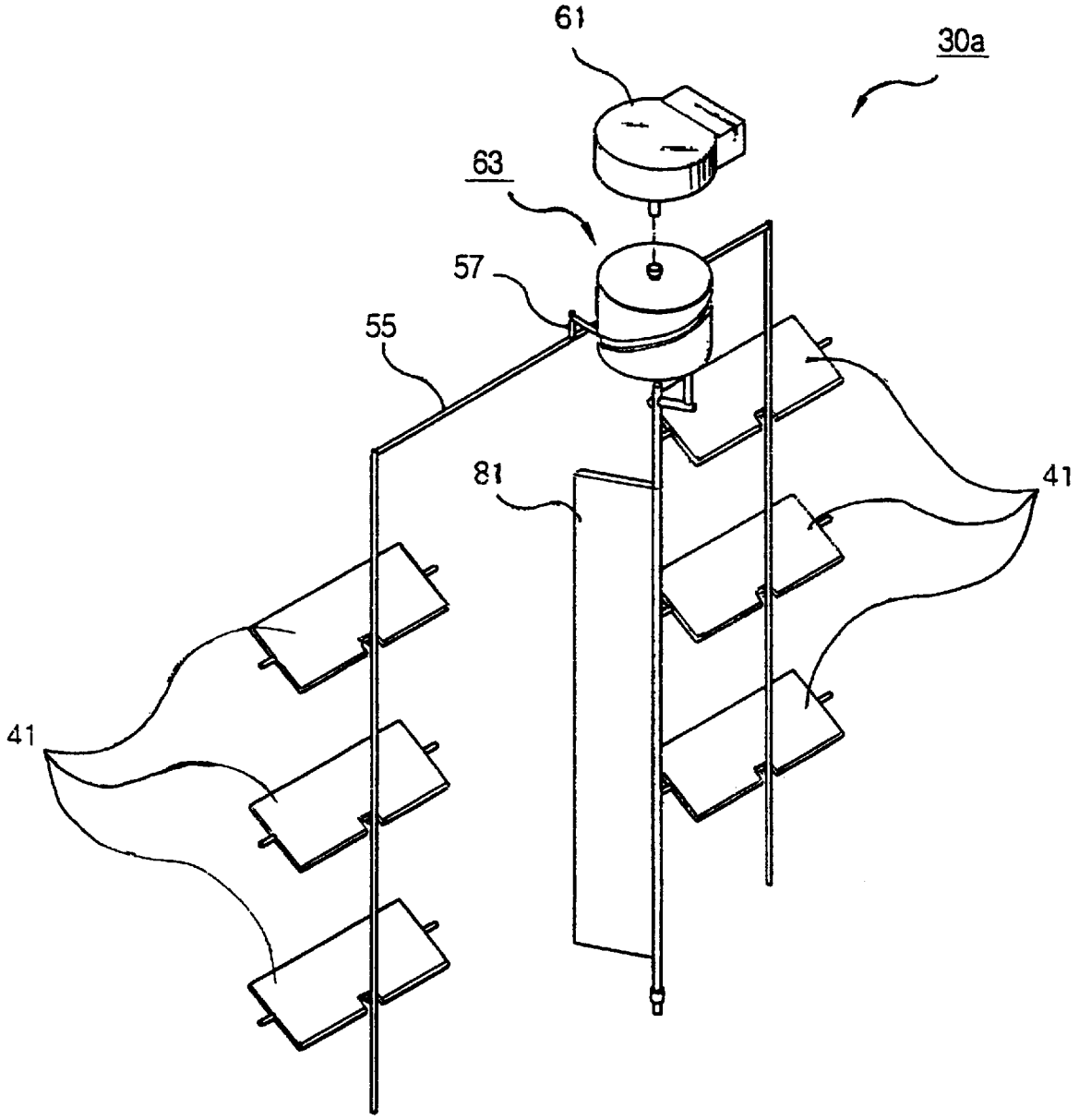
FIGS. 13 and 14 are views showing the cool air dispersing operation performed by the vertical dispersing blades and the horizontal guide blade shown in FIG. 10.
Figure 14:
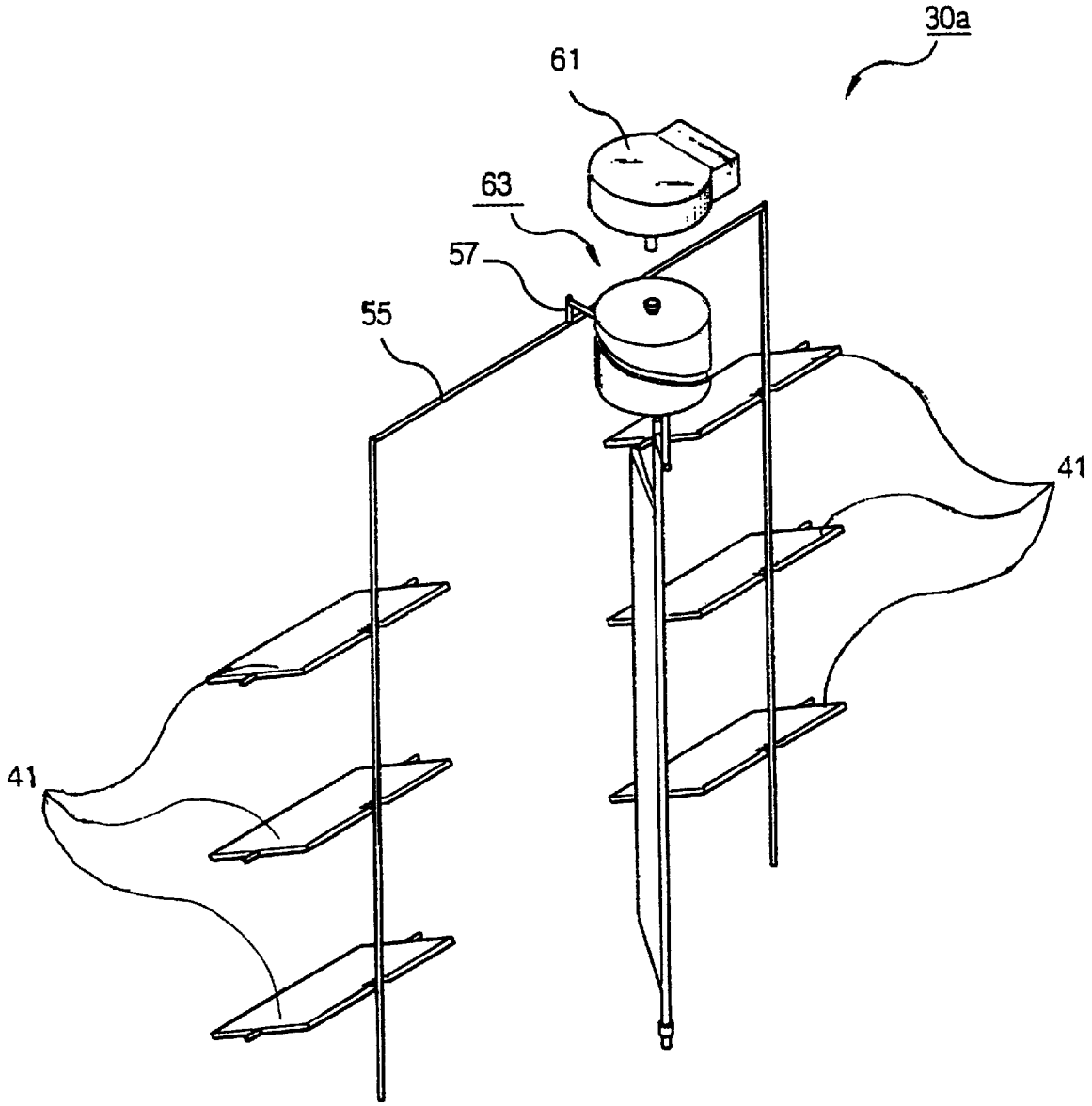
Figure 15:
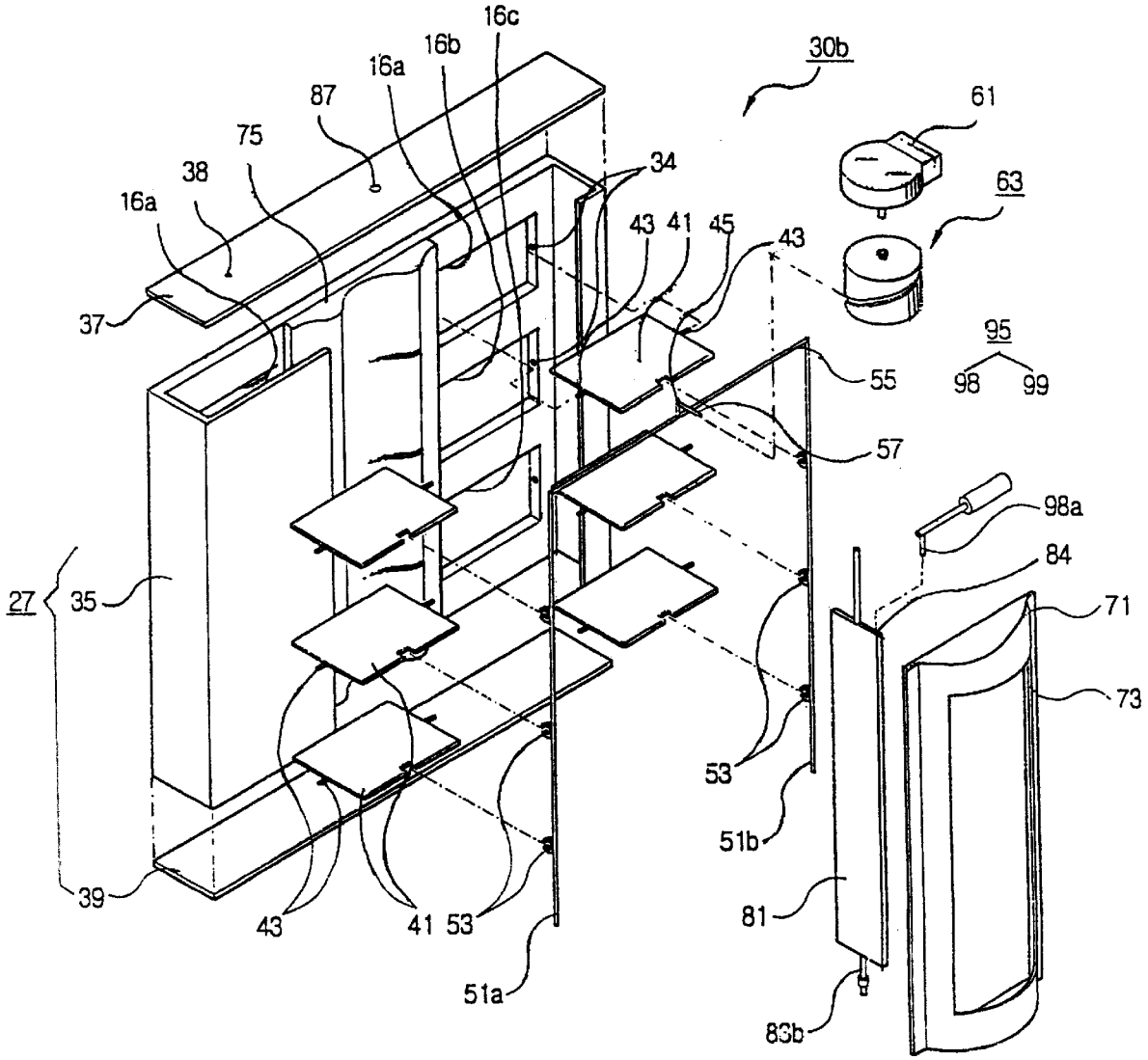
FIG. 15 is an enlarge exploded perspective view of a cool air dispersing device according to the third embodiment of the present invention.
Figure 16:
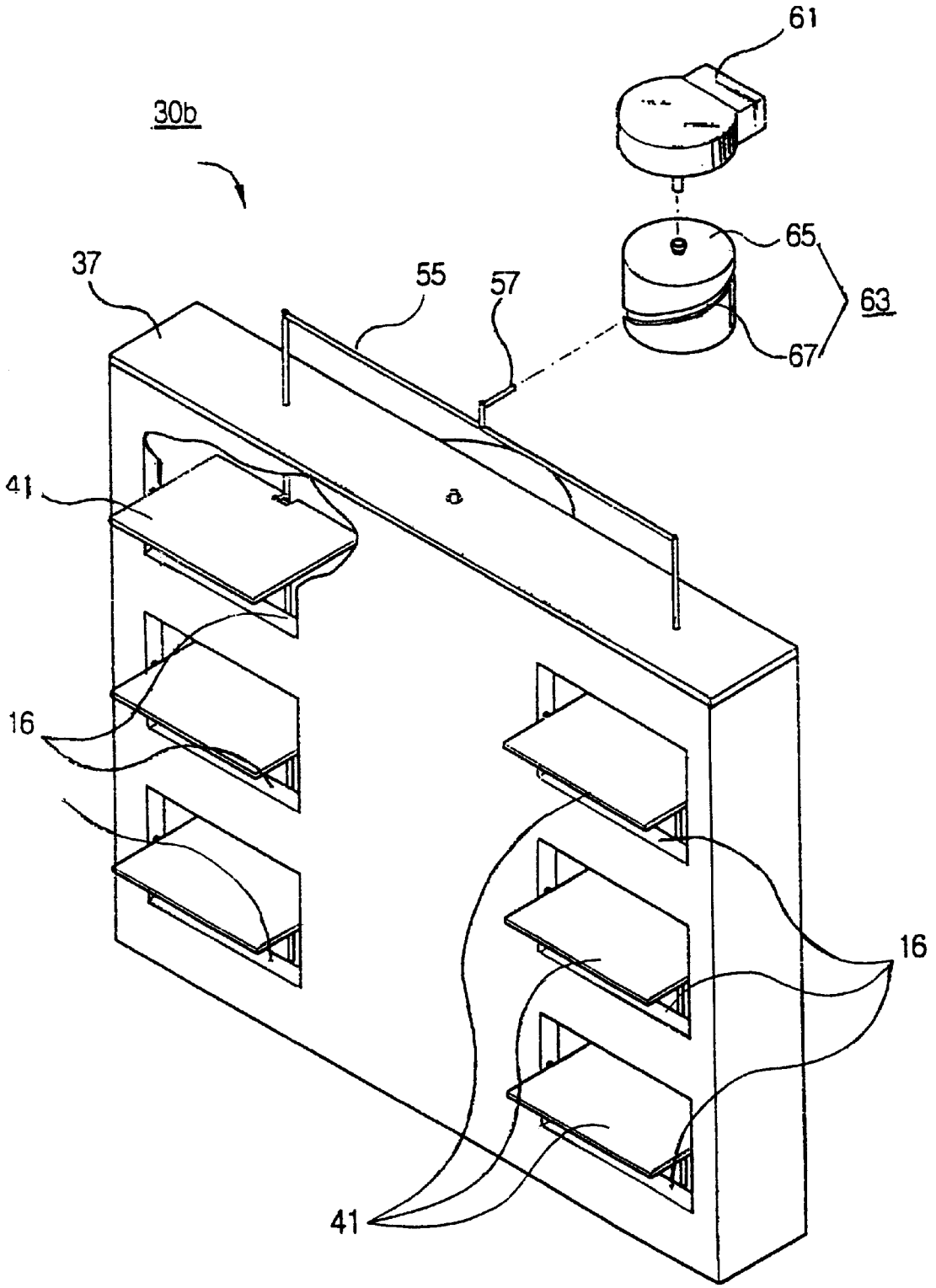
FIG. 16 is a perspective view of the assembled state of FIG. 15.
Figure 17:
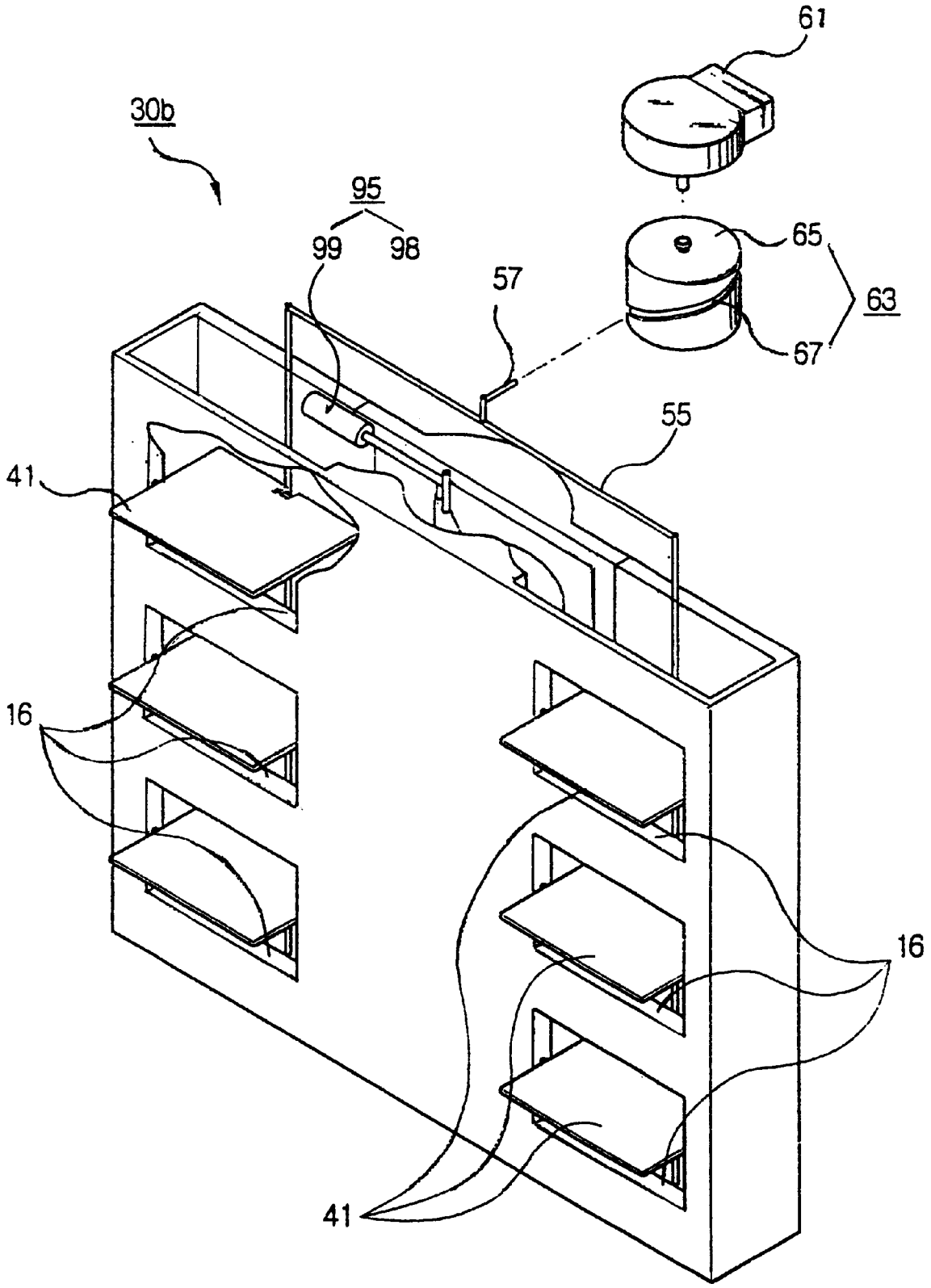
FIG. 17 is a partial cutaway view of FIG. 16.

As the driving cam 63 is rotated by the driving motor 61, the link members 51*a* and 51*b* are elevated/de-elevated, whereby the vertical dispersing blades 41 are reciprocally rotated in vertical direction within a predetermined angular range as shown in FIGS. 13 and 14. While the vertical dispersing blades 41 are continuously reciprocated, the cool air is dispersed vertically, and the cool air is supplied into the fresh food compartment 3 uniformly.

Meanwhile, while the cool air is dispersed vertically as described above, the horizontal dispersing blade 81 is reciprocally rotated within a predetermined angular range. Accordingly, the cool air in the cool air duct 15 flowing into the inner space of the duct cover 27 through the cool air supply hole 73 of the rear plate 71 is selectively guided toward the respective lines of the discharge ports 16*a*, 16*b* and 16*c* by the horizontal guide blade 81. That is, while the horizontal guide blade 81 is rotated left as shown in FIG. 13, the cool air is guided toward the left line of discharge ports 16*a*, 16*b* and 16*c*, and while the horizontal guide blade 81 is rotated right as shown in FIG. 14, the cool air is guided toward the right line of discharge ports 16*a*, 16*b* and 16*c*.

According to the present embodiment, since the cool air is selectively discharged toward the left or right discharge ports 16*a*, 16*b* and 16*c*, the uniform distribution of cool air can be achieved horizontally.

Furthermore, according to the present embodiment, the concentrative cooling on the area in the fresh food compartment 3 of which temperature is high can be performed more effectively. For example, if the temperature of the right lower area in the fresh food compartment 3 is sensed to be highest, the microprocessor drives the driving motor 61 so that the vertical dispersing blades 41 are rotated downward and the horizontal guide blade 81 is rotated right as shown in FIG. 14, and then stops the driving motor 61 in such a status. Then, the cool air is continuously discharged toward the right lower area of the fresh food compartment 3, and the temperature in the fresh food compartment becomes uniform in a short period of time.

Meanwhile, according to the present embodiment, as in the above-described first embodiment, the vortex of cool air is prevented by the vertical dispersing blades 41 having the shape of a plate. Further, the discharge ports 16*a*, 16*b* and 16*c* can be closed by maximally rotating the vertical dispersing blades 41 upward or downward, whereby the backflow of air in the fresh food compartment 3 into the cool air duct 15 can be prevented.

FIGS. 15 through 19 show the cool air dispersing device 30*b* according to the third embodiment of the present invention. In the description of the present embodiment, parts identical to those in the above-described first embodiment will not be illustrated and will be referred to with the same reference numerals.

In the cool air dispersing device 30*b* of the present embodiment, the constructions of the duct housing 20, the rear plate 71, the vertical dispersing blades 41, the link members 51*a* and 51*b*, and the driving motor 61 are the same as those of the above-described first embodiment. Meanwhile, the cool air dispersing device 30*b* further comprises, like the above-described second embodiment, a means for guiding the cool air so that the cool air is selectively discharged through the respective lines of the discharge ports 16*a*, 16*b* and 16*c*.

The guiding means comprises a horizontal guide blade 81 installed in the inner space formed by the duct cover 27, and a solenoid device 95 for driving the horizontal guide blade 81.

The horizontal guide blade 81 is, as described above, accommodated in the cylindrical space formed by the rear plate 71 protruding rearward and the guide member 75 recessed frontward. The horizontal guide member 81 is a rectangular plate, and is installed on a vertical shaft 83*b* disposed vertically.

The upper end of the vertical shaft 83*b* is inserted into the supporting hole 87 formed on the upper plate 37 of the duct cover 27, and the lower end thereof is inserted into another supporting hole (not shown) formed on the lower plate 39 of the duct cover 27. Therefore, the horizontal guide blade 81 is rotatable around the vertical shaft 83*b*. The cool air flowing into the inner space of the duct cover 27 is guided left or right according to the rotational position of the horizontal guide blade 81. Furthermore, an operation groove 84 cooperating with the solenoid device 95 is formed on the upper edge of the horizontal guide blade 81 at a position distanced from the vertical shaft 83*b*.

The solenoid device 95 comprises a core part 99 having a solenoid coil, and a driving rod 98 accommodated in the core part 99 so as to be capable of sliding. As the electrical power is applied to the core part 99, the driving rod 98 is moved along the longitudinal direction thereof. That is, as the electrical current is supplied from an electrical source (not shown) to the core part 99, the driving rod 98 is moved so that it protrudes from the core part 99, and as the reverse electrical current is supplied from the electrical source, the driving rod 98 is moved into the core part 99. A driving protrusion 98*a* protrudes downward at the end of the driving rod 98. The driving protrusion 98*a* is inserted into the operation groove 84 of the horizontal guide blade 81.

Figure 18:
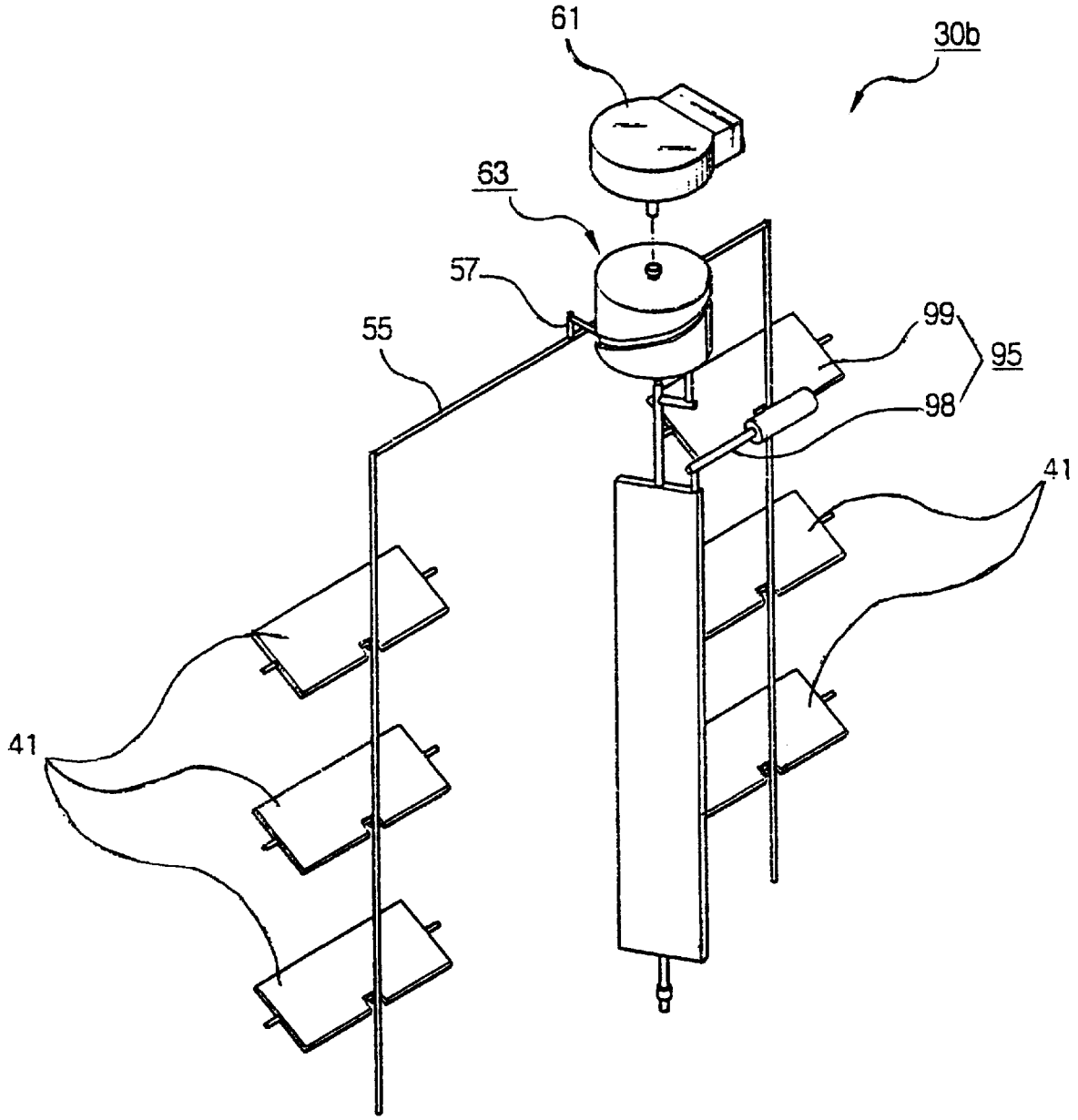
FIGS. 18 and 19 are views showing the cool air dispersing operation performed by the vertical dispersing blades and the horizontal guide blade shown in FIG. 16.
Figure 19:
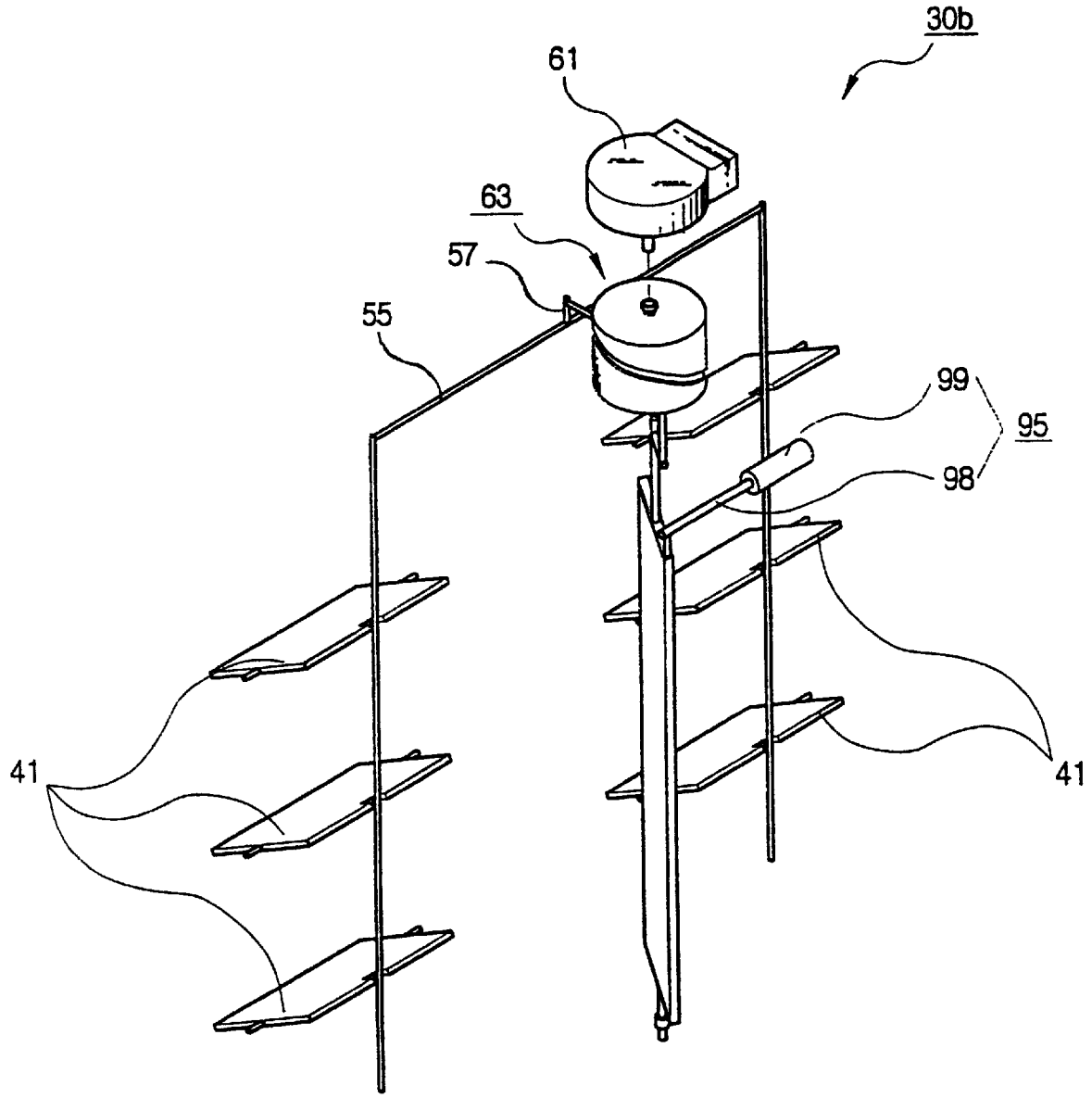

As the driving cam 63 is rotated by the driving motor 61, the link members 51*a* and 51*b* are elevated/de-elevated, whereby the vertical dispersing blades 41 are reciprocally rotated in vertical direction within a predetermined angular range as shown in FIGS. 18 and 19. While the vertical dispersing blades 41 are continuously reciprocated, the cool air is dispersed vertically, and the cool air is supplied into the fresh food compartment 3 uniformly.

Meanwhile, while the cool air is dispersed vertically as described above, the horizontal dispersing blade 81 is reciprocally rotated within a predetermined angular range by the solenoid device 95. Accordingly, the cool air in the cool air duct 15 flowing into the inner space of the duct cover 27 through the cool air supply hole 73 of the rear plate 71 is selectively guided toward the respective lines of the discharge ports 16*a*, 16*b* and 16*c* by the horizontal guide blade 81. That is, while the horizontal guide blade 81 is rotated left as shown in FIG. 18, the cool air is guided toward the left line of discharge ports 16*a*, 16*b* and 16*c*, and while the horizontal guide blade 81 is rotated right as shown in FIG. 19, the cool air is guided toward the right line of discharge ports 16*a*, 16*b* and 16*c*.

According to the present embodiment, since the cool air is selectively discharged through the left or right discharge ports 16*a*, 16*b* and 16*c* as the above-described second embodiment, the uniform distribution of cool air in the horizontal direction can be achieved effectively.

Moreover, in the present embodiment, unlike the above-described second embodiment, the horizontal guide blade 81 can be driven independently of the vertical dispersing blades 41 by the solenoid device 95, so the lines of the discharge ports 16*a*, 16*b* and 16*c* through which the cool air is discharged can be selected independently. Therefore, according to the present embodiment, the concentrative cooling on a specific area can be performed more easily.

Meanwhile, according to the present embodiment, as in the above-described first embodiment, the vortex of cool air is prevented by the vertical dispersing blades 41 having the shape of a plate. Further, the discharge ports 16*a*, 16*b* and 16*c* can be closed by maximally rotating the vertical dispersing blades 41 upward or downward, whereby the backflow of air in the fresh food compartment 3 into the cool air duct 15 can be prevented.

As described above, according to the present invention, the vortex of the cool air about the cool air discharge ports does not occur since the cool air dispersing blades have the shape of a planar plate. Further, since the discharge ports are closed while the cooling system is not operating, the backflow of air in a cooling compartment toward evaporator is prevented, whereby less frost is generated on the evaporator and cooling efficiency is improved. In particular, the horizontal discharge direction of cool air can be controlled by the horizontal guide blade, so the cool air can be uniformly dispersed vertically and horizontally, and a concentrative cooling on a specific area can be performed effectively.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator comprising:

an evaporator for generating cool air;

an air circulation device for creating a forced flow of the cool air;

a duct housing forming a cool air duct for guiding the forced flow of cool air, said duct housing having a plurality of cool air discharge ports open into a cooling compartment of the refrigerator for discharging the forced flow of cool air into the cooling compartment;

a plurality of cool air dispersing blades of planar plate shape corresponding to the discharge ports respectively, said cool air dispersing blades being capable of rotating, said cool air dispersing blades for controlling a discharge direction of the forced cool air flow supplied into said cooling compartment according to a rotational position thereof, and for closing the discharge ports at a predetermined rotational position thereof in response to a termination of the forced air flow to the cooling compartment to prevent a backflow of air out of the cooling compartment; and a means for rotating said cool air dispersing blades.

2. The refrigerator as claimed in claim 1, wherein said rotating means comprises:

a link member having a plurality of hinge assembly parts assembled with said cool air dispersing blades at positions distanced from rotational axes thereof;

a driving motor for driving said link member; and a driving cam for converting a rotational movement of said driving motor to a reciprocal movement of said link member.

3. The refrigerator as claimed in claim 2, wherein said driving cam comprises a cam body assembled coaxially with a driving shaft of said driving motor and formed with a cam groove on an outer surface thereof; and said link member has an operation protrusion engaged with the cam groove.

4. The refrigerator as claimed in claim 2, wherein the discharge ports and said cool air dispersing blades are disposed so as to form a pair of lines.

5. The refrigerator as claimed in claim 4, further comprising a means for guiding the cool air in said cool air duct toward the respective lines of the discharge ports, selectively.

6. The refrigerator as claimed in claim 5, wherein said guiding means comprises:

a guide blade installed rotatably between the lines of the discharge ports, said guide blade for selectively guiding the cool air toward the respective lines of the discharge ports according to a rotational position thereof; and a means for driving said guide blade.

7. The refrigerator as claimed in claim 6, wherein said driving means comprises a pivoting protrusion formed on said guide blade at a position distanced from a rotational axis thereof, said pivoting protrusion being engaged with a pivoting groove which is formed on said driving cam and has a shape of an ellipse substantially.

8. The refrigerator as claimed in claim 6, wherein said driving means comprises a solenoid device having a core part fixed on a predetermined position, and a driving rod reciprocated by said core part and assembled with said guide blade at a position distanced from a rotational axis thereof.

9. The refrigerator as claimed in claim 1, wherein said cool air dispersing blades are vertical dispersing blades capable of rotating about horizontal axes respectively, said vertical dispersing blades for controlling a vertical discharge direction of the cool air supplied into said cooling compartment according to a rotational position thereof.

* * * * *